US005548913A

United States Patent [19]

Randolph et al.

[11] Patent Number: 5,548,913

[45] Date of Patent: Aug. 27, 1996

[54] APPARATUS AND METHOD FOR DISPLAYING A REPRESENTATION OF A WHEELED VEHICLE IN VARIOUS POSES WITH RESPECT TO A PICTORIAL SCENE

[76] Inventors: Steven J. Randolph, 21115 Devonshire St., #138, Chatsworth, Calif. 91311; Curtis D. Randolph, 44142 Begonia St., Lancaster, Calif. 93535

[21] Appl. No.: 359,203

[22] Filed: Dec. 19, 1994

[51] Int. Cl.[6] ..... G09F 11/00

[52] U.S. Cl. ..... 40/491; 40/124.1; 116/321; 446/149

[58] Field of Search ..... 40/124.1, 421, 40/491; 116/321, 323, 324; 446/149, 151

[56] References Cited

U.S. PATENT DOCUMENTS 1,898,308 2/1933 Miller ..... 40/491 X
1,988,045 1/1935 Morris ..... 40/491 X
2,045,864 6/1936 Miller ..... 40/421
2,432,318 12/1947 Leech ..... 446/151

*Primary Examiner*—Brian K. Green
*Attorney, Agent, or Firm*—Timothy T. Tyson; Freilich, Hornbaker & Rosen

[57] ABSTRACT

An apparatus 30 and method for displaying a representation of the outline 44 of a wheeled vehicle in various poses with respect to a pictorial scene 38. The apparatus 30 comprises a pictorial scene 38 disposed upon a substantially planar background element 32. Two spaced straps 58 serve as the vehicle's wheels 40 and 42 and are engaged by T-shaped slots 64 and 66 in outline 44 so that outline 44 may be selectively slidably moved along straps 58 thereby assuming a plurality of poses with respect to the pictorial scene 38 and the wheels 40 and 42.

10 Claims, 9 Drawing Sheets

FIG. 3
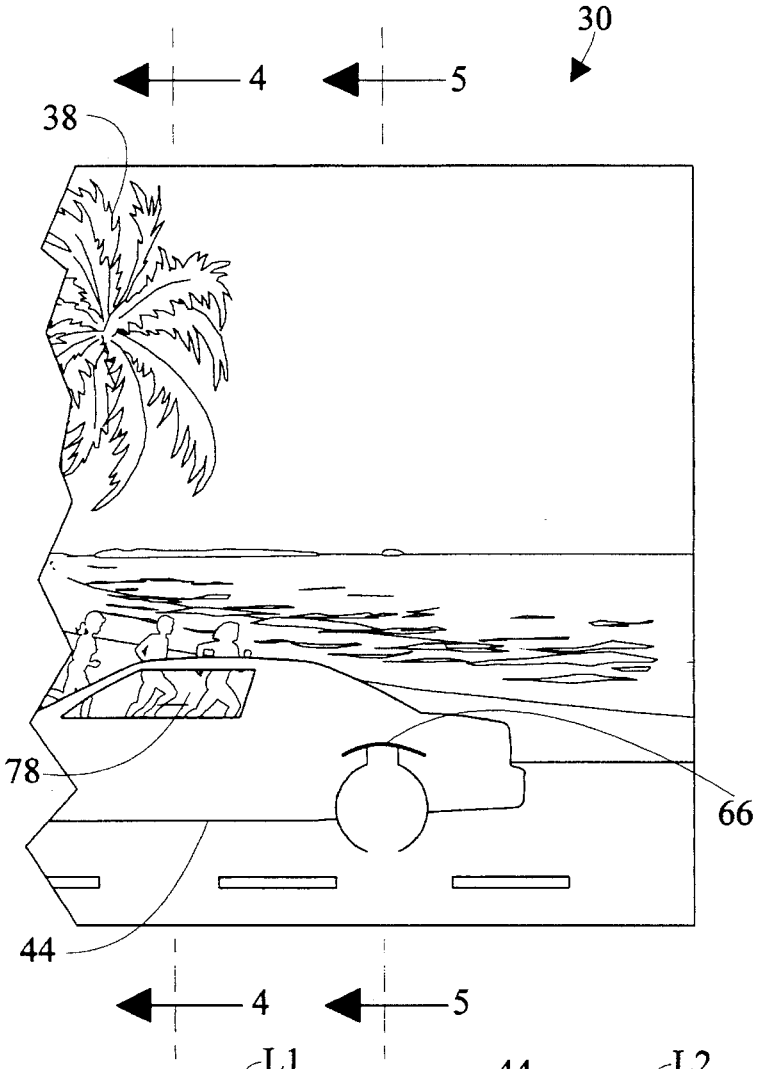
FIG. 4
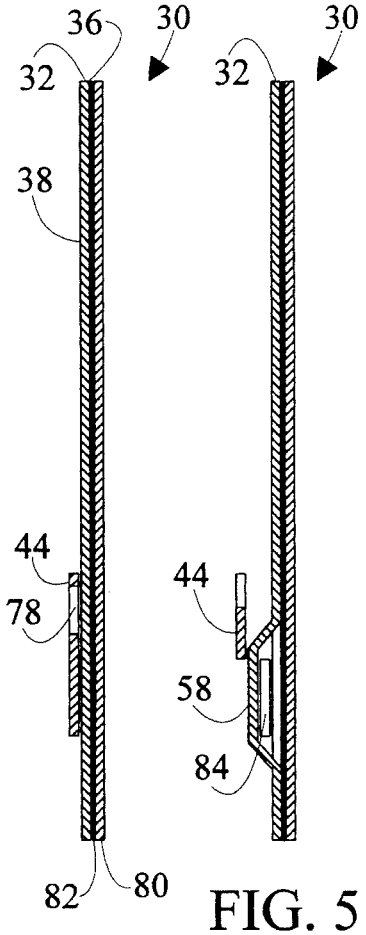
FIG. 5
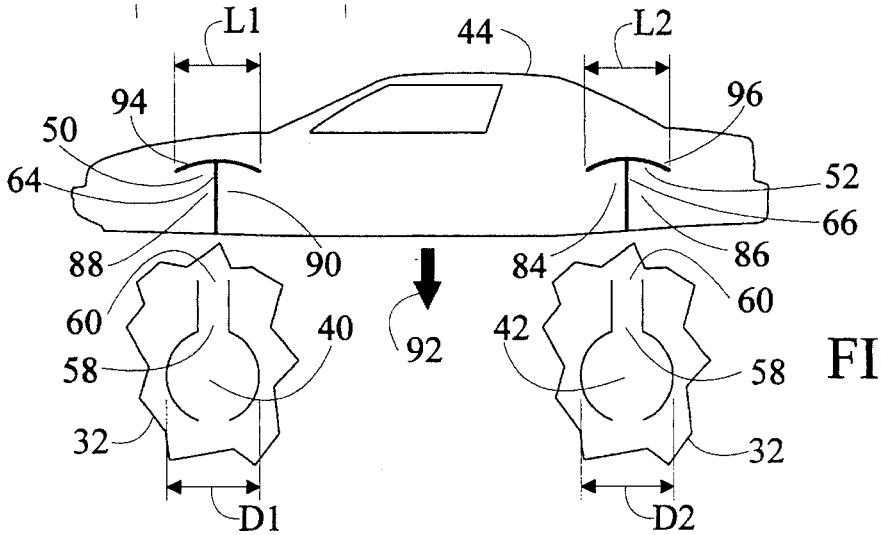
FIG. 6

APPARATUS AND METHOD FOR DISPLAYING A REPRESENTATION OF A WHEELED VEHICLE IN VARIOUS POSES WITH RESPECT TO A PICTORIAL SCENE

TECHNICAL FIELD

The present invention pertains to an apparatus and method for displaying a representation of a wheeled vehicle in various poses with respect to a pictorial scene, and more particularly to an apparatus wherein the body of the vehicle can be raised or lowered relative to both the scene and the vehicle's wheels.

BACKGROUND ART

Devices for displaying movable representations of objects have been known in the art for many years. These devices are typically directed to amusement or advertising and usually consist of objects which move relative to a fixed background scene. For example, U.S. Pat. No. 412,394 shows a movable sign which is attached within horse-cars and other vehicles and which will be vibrated by the motion of the vehicle so as to attract the eye. U.S. Pat. No. 622,111 describes a toy picture book wherein the figures or objects or parts thereof are movable. The opening of the leaves of the book automatically sets in motion a motor and associated mechanism which causes the figures or objects to perform their movements. U.S. Pat. No. 956,916 discloses a display card which includes a plurality of leaves or sections having representations that when properly manipulated appear in relief or perspective and in proper relative positions. The scenes contained on the leaves may be varied of changed as may be desirable. U.S. Pat. No. 1,201,913 depicts a mechanical bill-board having objects that are given reciprocatory, oscillatory, rotary, or other motion with respect to the bill-board for the purpose of advertising. An electric motor and associated gearing cause the objects to move. U.S. Pat. 1,339,892 reveals a process of securing depth and relief for commercial advertising. Natural depth or relief is obtained by mounting a plurality of layers of thick cardboard together and cutting away certain portions of the layers. U.S. Pat. No. 1,538,178 defines an advertising apparatus especially adapted for outdoor advertising. The apparatus comprises movable scenery representing a landscape or such and includes a traversing vehicle. U.S. Pat. No. 1,763,652 portrays a photographic cutout which includes a stock cutout picture together with a cutout photograph. The stock cutout and the photographic cutout are mounted upon a backing in a manner whereby the mounted photograph merges with the stock cutout to produce a complete picture. U.S. Pat. No. 2,110,646 shows an animated advertising device adapted for installation in a vehicle. The animation is derived from the motion of the vehicle. U.S. Pat. No. 2,126,567 describes an advertising display apparatus for use either as roadside installation, window display equipment, or a toy. In one embodiment, a particular make of automobile is pictorially represented on an attractive background. The representation includes real automobile wheels adapted for revolution. U.S. Pat. No. 2,148,279 discloses a folding postcard or window display. The device consists of a pictorial illustration, cutout features of a principal subject or subjects standing out in relief from the illustration, and a means for folding the illustration and cutout features. U.S. Pat. No. 2,429,335 depicts and animated illustration which consists of illustrated pieces which move upon an illustrated front sheet. The illustrated pieces are activated by a back sheet rocker member. U.S. Pat. No. 2,656,643 reveals a figure toy with spinning element. The toy is drawn over a flat surface with the effect of performing some action or motion. U.S. Pat. No. 2,884,738 portrays a greeting card containing an animated object. The animation is achieved as the card is opened or closed. U.S. Pat. No. 3,142,919 shows an animated display which is intended for use on advertising signs. An electric motor imparts the motion. U.S. Pat. No. 3,427,642 describes an animated display device in the form of a greeting card that has a freely oscillatable member coupled to the card via a coiled spring. U.S. Pat. No. 3,462,873 discloses a toy television receiver consisting of a cabinet having a window and a background screen. Figures carrying a magnetic responsive metal are moved across the background screen by means of a permanent magnet. U.S. Pat. No. 3,994,091 depicts a card having a picture which can be manipulated to effect animation of the picture. The card contains a bend which can be moved between extended and contracted positions to effect animation of at least a part of the picture. U.S. Pat. No. 5,139,454 reveals a greeting card which contains a display portion having moveable parts. The card is battery operated the display portion being animated when the card is opened.

DISCLOSURE OF INVENTION

The present invention is directed to a display apparatus and method for showing a wheeled vehicle in various poses with respect to a pictorial scene. The outline of the body of the vehicle may be slidably moved up or down with respect to the wheels, which are part of the pictorial scenes to give the viewer the impression of a raised or lowered vehicle. First and second pose-positioning means effect the slidable motion.

In accordance with a preferred embodiment of the invention, the apparatus comprises a substantially planar background element having an illustration consisting of a pictorial scene. The first and second wheels of the vehicle are integral with the background element, and form straps along which the two wheel wells of the vehicle may slide, the vehicle thereby assuming an infinite number of poses with respect to the pictorial scene and the wheels.

In accordance with an important feature of the invention, the wheel wells are independently slidable with respect to the pictorial scene and the wheels having a substantially vertical direction of slidability.

In accordance with an important aspect of the invention, the first and second wheel wells have upward and downward limits of slidability imposed by the first and second pose-positioning means.

In accordance with another important feature of the invention, the outline of the vehicle includes an aperture in the shape of a window permitting the pictorial scene to be viewed therethrough.

In accordance with another important aspect of the inventions the outline of the vehicle is removably connected to the background element and may be selected from a plurality of possible outlines.

In accordance with a preferred embodiment of the inventions the outline of the vehicle and the wheels both move with respect to the background element and with respect to each other.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 3 is a fragmented front elevation view of the apparatus;

FIG. 4 is a cross sectional view along the line 4—4 of FIG. 3;

FIG. 5 is a cross sectional view along the line 5—5 of FIG. 3;

FIG. 6 is a front elevation view of the body of the vehicle and mounting straps;

MODES FOR CARRYING OUT THE INVENTION

Figure 1:
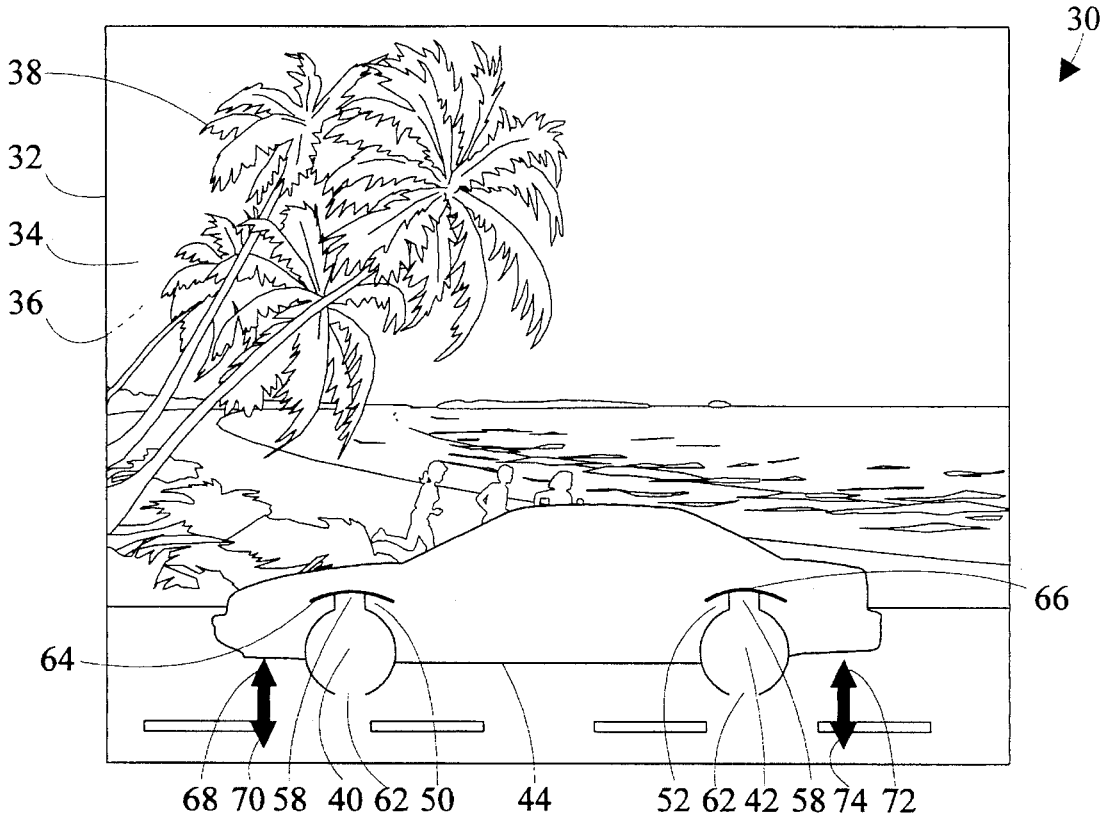
FIG. 1 is a front elevation view of an apparatus in accordance with the present invention.
Figure 2:
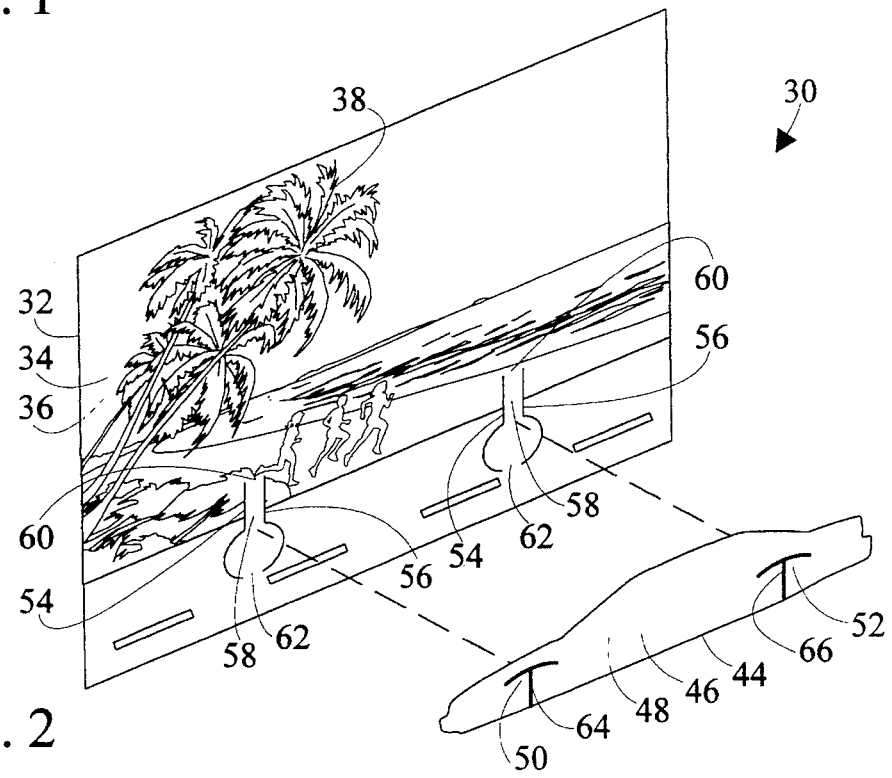
FIG. 2 is a reduced exploded perspective view of the apparatus.

Referring initially to FIGS. 1 and 2 there are illustrated front elevation and reduced exploded perspective views of an apparatus for displaying a representation of a vehicle in various poses with respect to a pictorial scene in accordance with the present invention, generally designated as 30. The apparatus comprises a substantially planar background element 32 having a first side 34 and a second side 36. A pictorial scene 38 is disposed on first side 34. In the shown embodiment pictorial scene 38 is of the beach with a road having stripping in the foreground. A first vehicle wheel 40 and a second vehicle wheel 42 are integral with background element 32. A substantially planar outline 44 of the body of the vehicle has a first side 46 and a second side 48. The outline 44 also has a first wheel well 50 spaced a predetermined distance from a second wheel well 52. Outline 44 is removably connected to background element 32 and therefore may be selected from a plurality of possible outlines 44 representing different vehicles. A first pose-portioning means is connected to background element 32 and slidably engages first wheel well 50, and a second pose-positioning means is connected to background element 32 and slidably engages second wheel well 52. In the embodiment shown, the first and second pose-positioning means each comprise two spaced slits 54 and 56 forming a strap 58 having ends 60 and 62 connected to background element 32. Straps 58 have a lower shaped portion which forms wheels 40 and 42. Wheels 40 and 42 have a predetermined diameter D (refer to FIG. 6). Wheel wells 50 and 52 have T-shaped cuts 64 and 66 which slidably engage straps 58. First wheel well 50 and second wheel well 52 are independently slidable with respect to straps 58 and the pictorial scene 38 in directions 68 and 70, and 72 and 74 respectively. Outline 44 may thereby assume a plurality of poses with respect to pictorial scene 38 and wheels 40 and 42. In a preferred embodiment the direction of slidability is substantially vertical with respect to pictorial scene 38.

FIG. 3 is a fragmented front elevation view of the apparatus showing an aperture 78 in outline 44 so that pictorial scene 38 may be viewed therethrough. Aperture 78 is in the shape of a window.

FIG. 4 is a cross sectional view along the line 4—4 of FIG. 3. Outline 44 having window aperture 78 is connected in front of background element 32. In a preferred embodiment background element 32 and outline 44 are fabricated from stiff paper. Pictorial scene 38 may be integral with background element 32 such as would be the case for a photograph printed on heavy paper, may be a separate illustration adhesively or otherwise connected to background element 32, or could alternatively be drawn or painted upon background element 32. In the shown embodiment, a substantially planar backing 80 of heavy paper or light cardboard is connected by adhesive 82 to second side 36 of background element 32 to provide mechanical support.

FIG. 5 is a cross sectional view along line 5—5 of FIG. 3. T-shaped cut 66 (refer to FIG. 3) of outline 44 slidably engages strap 58 of background element 32. Flap 84 of T-shaped cut 66 (refer to FIG. 6) is positioned behind strap 58 thereby holding outline 44 in place.

FIG. 6 is a front elevation view of outline 44 and mounting straps 58 integral with background element 32 (fragmented view). T-shaped cuts 64 and 66 have flaps 84 and 86 and 88 and 90 respectively. Flaps 84 and 86, and 88 and 90 are positioned behind straps 58 as outline 44 is moved in direction 92 to connect and engage straps 58. The first wheel well 50 and second wheel well 52 have upward and downward limits of slidability imposed by the first and second pose-positioning means. Wheels 40 and 42 have predetermined diameters D1 and D2 respectively. Top cross slits 94 and 96 of T-shaped cuts 64 and 66 have predetermined lengths L1 and L2 respectively. Lengths L1 and L2 are less than diameters D1 and D2 so that top slits 94 and 96 cannot pass over wheels 40 and 42 thereby limiting the downward excursion of wheel wells 50 and 52. The upward excursion of wheel wells 50 and 52 is limited by top end 60 of strap 58.

Figure 7:
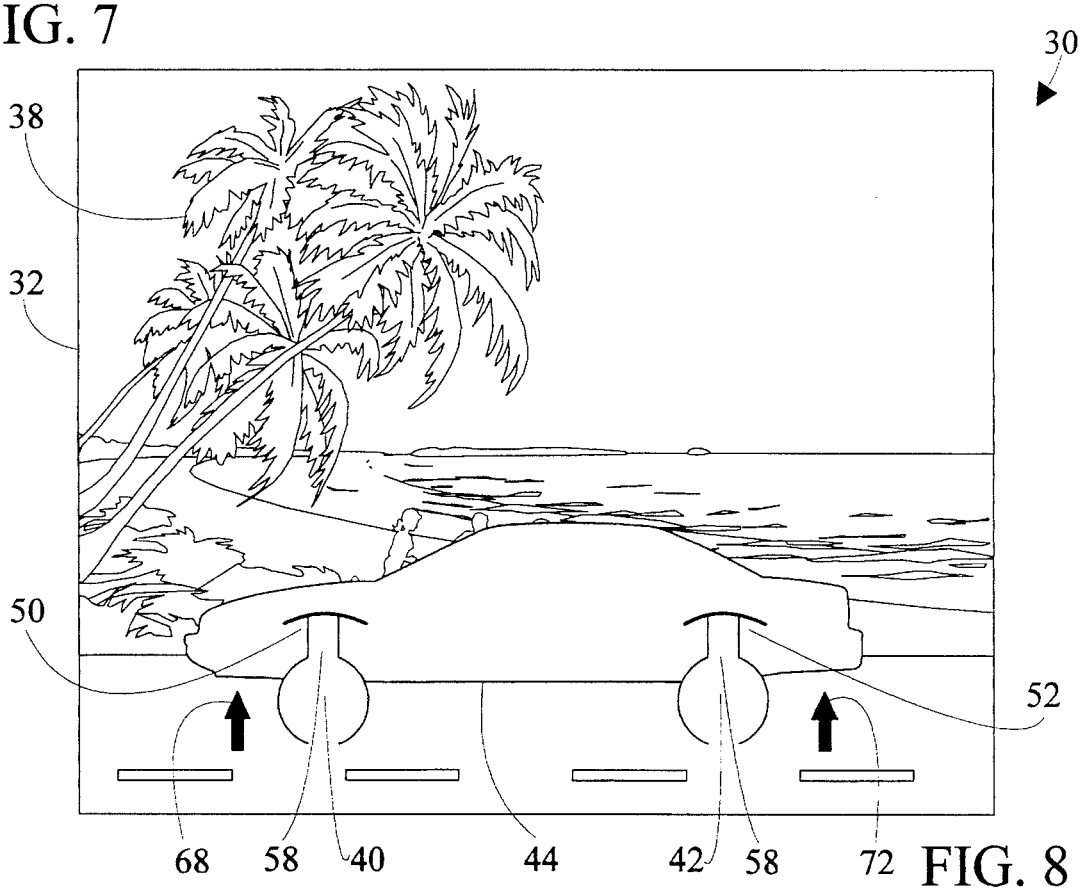
FIG. 7 is a front elevation view of the apparatus showing the vehicle in a first pose.
Figure 8:
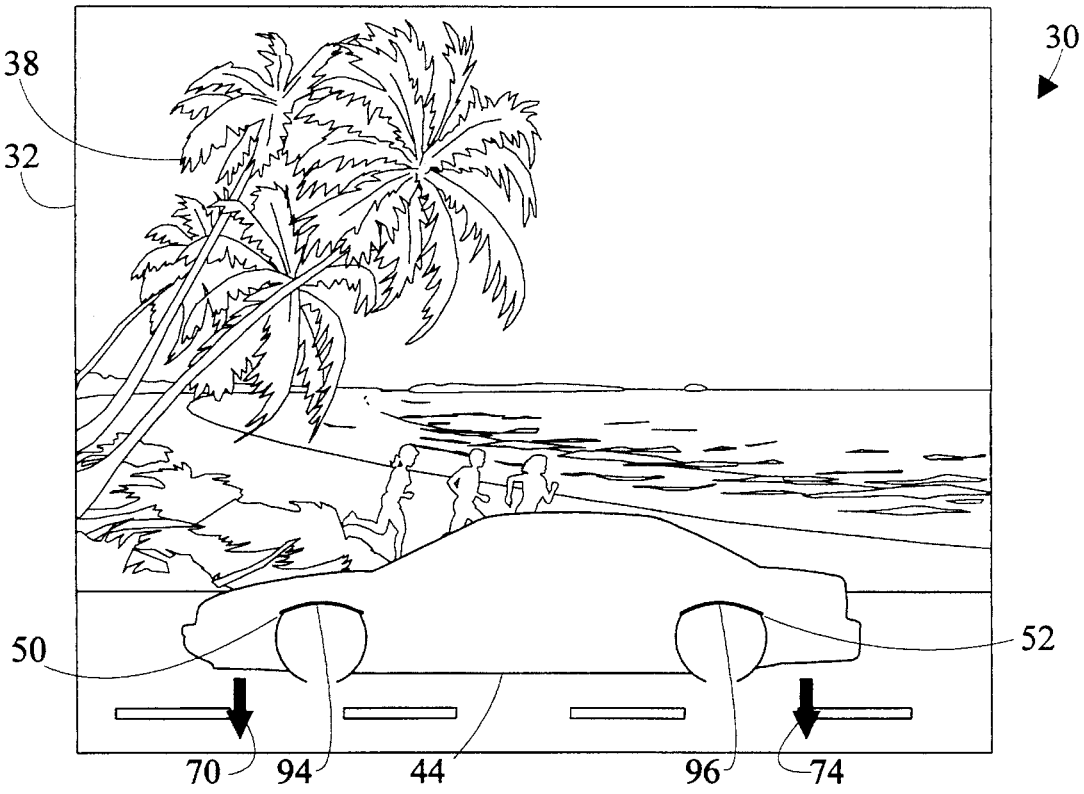
FIG. 8 is a front elevation view of the apparatus showing the vehicle in a second pose.
Figure 9:
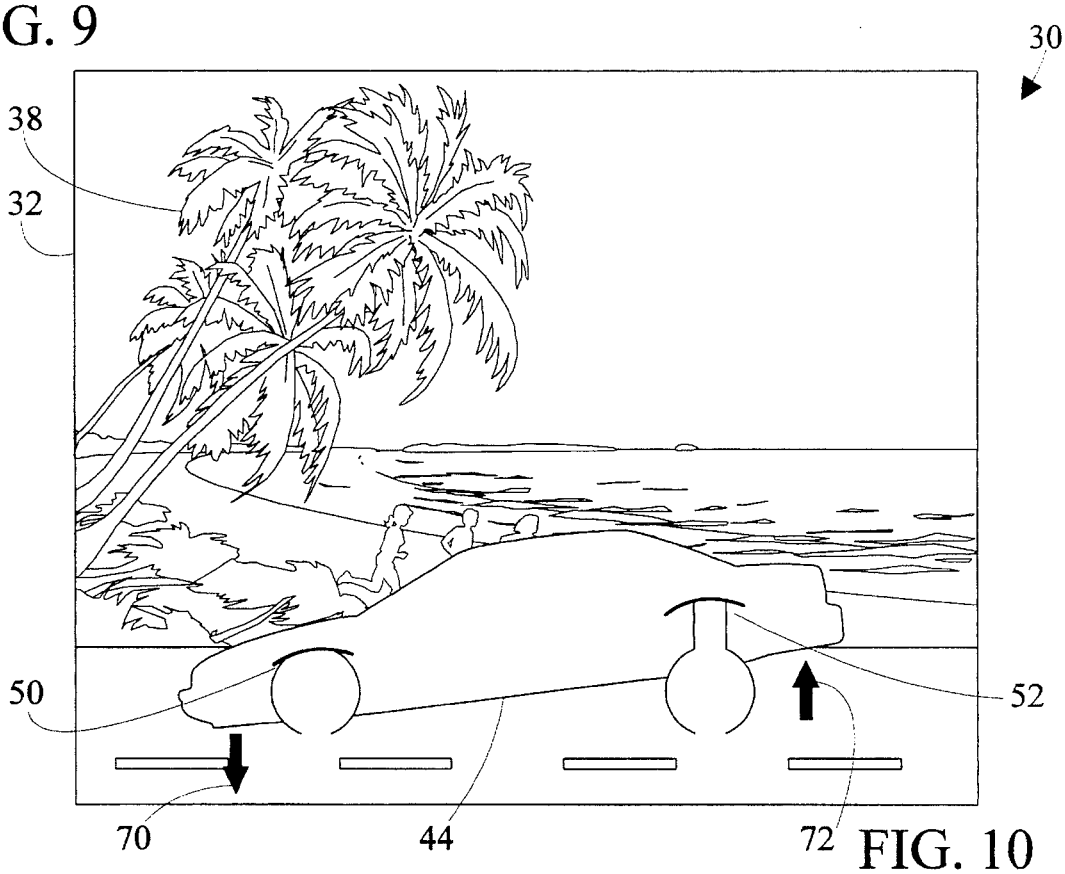
FIG. 9 is a front elevation view of the apparatus showing the vehicle in a third pose.
Figure 10:
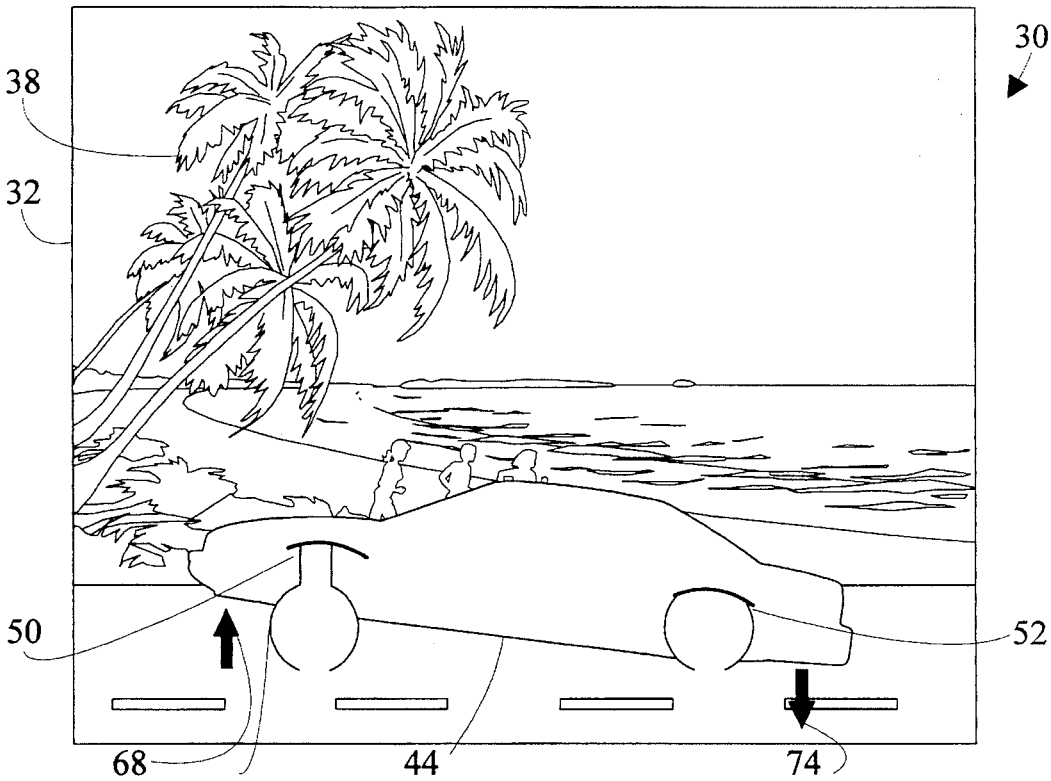
FIG. 10 is a front elevation view of the apparatus showing the vehicle in a fourth pose.

FIGS. 7, 8, 9, and 10 are front elevation views of apparatus 30 showing outline 44 of the vehicle in various poses with respect to background element 32, pictorial scene 38, and wheels 40 and 42. In FIG. 7 first wheel well 50 and second wheel well 52 of outline 44 have been slidably moved to the uppermost position permitted by end 60 (refer to FIG. 6) of strap 58 in directions 68 and 72 respectively. This configuration gives a viewer the impression of a vehicle outline 44 that is raised upon all four wheels. Conversely, in FIG. 8 first wheel well 50 and second wheel well 52 of outline 44 have been slidably moved to the lowermost position permitted by top cross slits 94 and 96 in directions 70 and 74 respectively. This configuration gives the viewer the impression of a vehicle outline 44 that is lowered upon all four wheels, or in common terminology a "low rider". In FIG. 9 first wheel well 50 of outline 44 has been slidably moved to the lowermost position in direction 70 and second wheel well 52 of outline 44 has been slidably moved to the uppermost position in direction 72. In FIG. 10 first wheel well 50 of outline 44 has been slidably moved to the uppermost position in direction 68 and second wheel well 52 of outline 44 has been slidably moved to the lowermost position in direction 74.

It is noted that as the first wheel well 50 and second wheel well 52 are moved to the positions shown in FIGS. 7, 8, 9, and 10, outline 44 assumes noticeably different postures or poses with respect to background portion 32 and pictorial scene 38 disposed thereon. Also, it may be readily appreciated that while FIGS, 7, 8, 9, and 10 show first wheel well 50 and second wheel well 52 at the extreme excursions permitted by straps 58, an infinite number of independent intermediate positions are also possible. Further, successive manipulation of outline 44 can result in a "hopper" effect wherein the front or rear of the vehicle bounces up and down.

Figure 11:
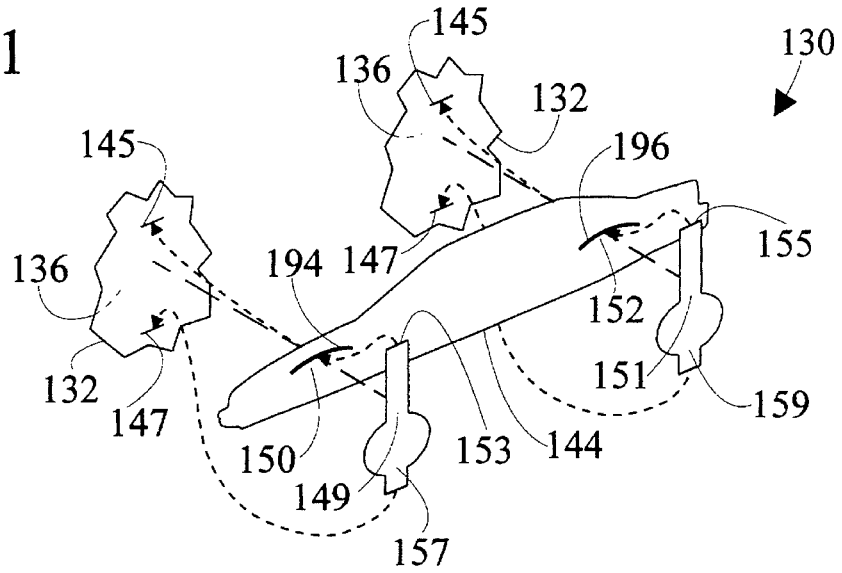
FIG. 11 is a reduced exploded perspective view of a second embodiment.

FIG. 11 is a reduced exploded perspective view of a second embodiment, generally designated as 130. Background element 132 has two spaced substantially parallel substantially horizontal slots, top slot 145 and bottom slot 147. Tabs 149 and 151 having first ends 153 and 155 respectively, and second ends 157 and 159 respectively. Second ends 157 and 159 form the shape of a wheel. Outline 144 of a vehicle has two tab-receiving slot 194 and 196 in first wheel well 150 and 152 sized to receive tabs 149 and 151 respectively. First ends 153 and 155 of tabs 149 and 151 respectively are inserted through tab-receiving slots 194 and 196 in wheel wells 150 and 152 and thence through top slots 145 and mechanically or adhesively connected to second side 136 of background element 132. Second ends 157 and 159 of tabs 149 and 151 are inserted through bottom slots 147 and mechanically or adhesively connected to second side 136 of background element 132.

Figure 12:
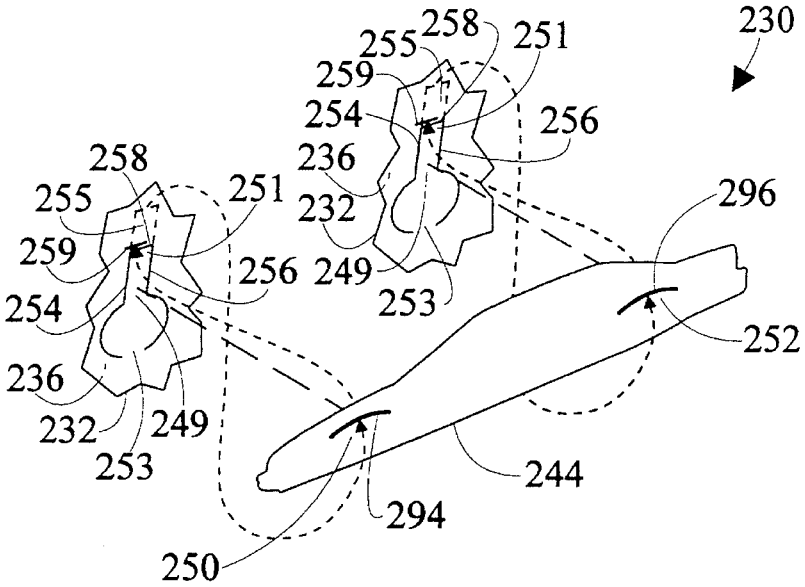
FIG. 12 is a reduced exploded perspective view of a third embodiment.

FIG. 12 is a reduced exploded perspective view of a third embodiment, generally designated as 230. Background element 232 has two spaced substantially vertical slits 254 and 256 and substantially horizontal slit 258 intersecting vertical slits 254 and 256 to form tabs 249 having first end 251 and second end 253, second end 253 being integral with background element 232, and having the shape of a wheel. Tab extension 255 is connected to first end 251 of tab 249. Background element 232 has horizontal slot 259. Wheel wells 250 and 252 in outline 244 have tab-receiving slots 294 and 296 sized to receive tab 249. Tab extension 255 is inserted through tab-receiving slots 294 and 296 in wheel wells 250 and 252 and thence through slot 259 in background element 232 and connected to second side 236 of background element 232.

Figure 13:
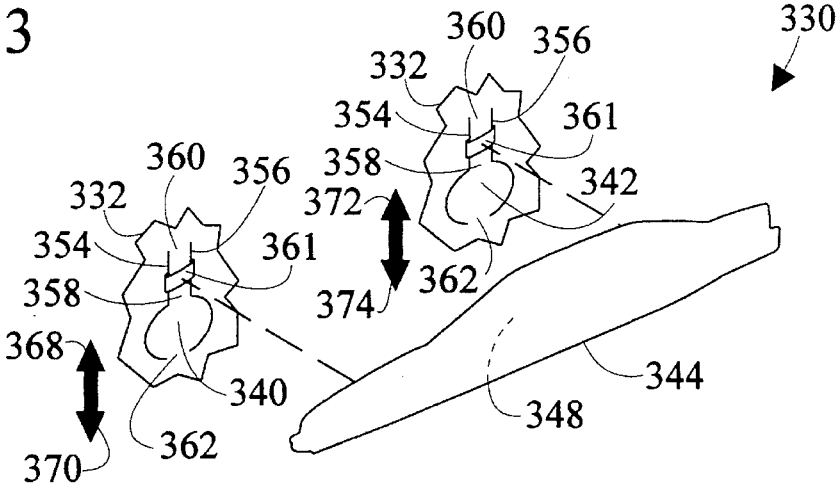
FIG. 13 is a reduced exploded perspective view of a fourth embodiment.

FIG. 13 is a reduced exploded perspective view of a fourth embodiment, generally designated as 330. Background element 332, has two spaced substantially vertical slits 354 and 356 forming strap 358 having ends 360 and 362 connected to background element 332. The lower portion of strap 358 has the shape of wheels 340 and 342. A Strap-gripping means is fixedly attached to second side 348 of outline 344, and is slidably connected to strap 358. In the embodiment shown, strap-gripping means consists of a flattened sleeve 361 which surrounds strap 358. Other strap-gripping means which fully or partially surround strap 358 would also be effective. Outline 344 may be moved in directions 368 and 370, and 372 and 374 along straps 358. It is noted that outline 344 may be connected to strap-gripping means by adhesives such as glue, or mechanically through the use of staples, Velcro™ or the like.

Figure 14:
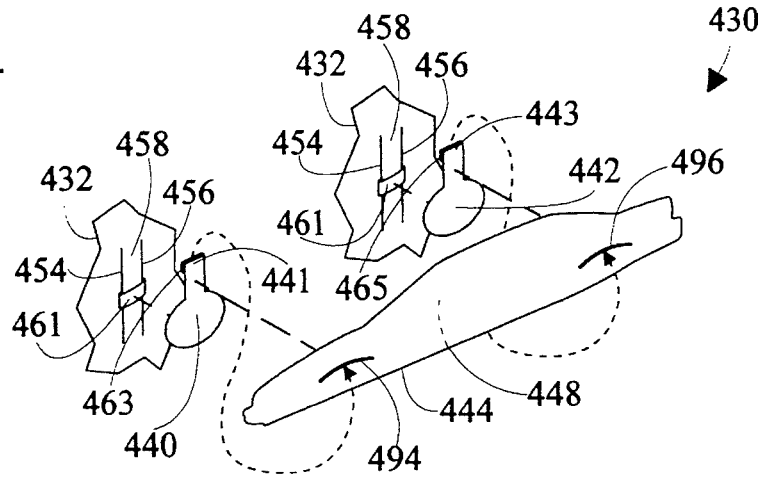
FIG. 14 is a reduced exploded perspective view of a fifth embodiment.

FIG. 14 is a reduced exploded perspective view of a fifth embodiment generally designated as 430. In this embodiment outline 444 and wheels 440 and 442 both move with respect to background element 432 and with respect to each other. First and second pose-positioning means consist of background element 432 having two spaced slits 454 and 456 forming strap 458 having ends connected to background element 432. Wheel tabs 440 and 442 have one end in the shape of a wheel, and are fixedly attached to strap-gripping means flattened sleeve 461 which is slidably connected to strap 458. Third and fourth pose-positioning means consist of first ends 441 and 443 of wheel tabs 440 and 442 being inserted into and slidably engaging tab-receiving slots 494 and 496 of outline 444 respectively. Stops 463 and 465 are connected to first ends 441 and 443 and serve to both retain and limit the upward excursion of outline 444 by engaging second side 448 of outline 444.

Figure 15:
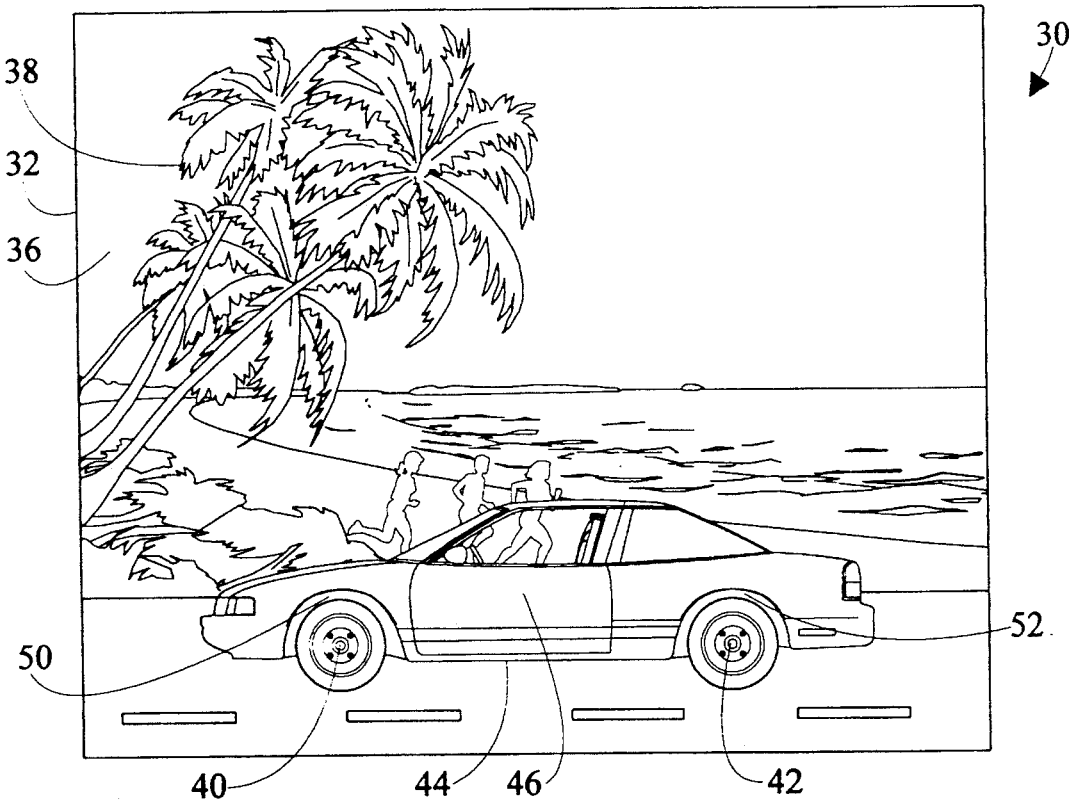
FIG. 15 is a front elevation view of showing the pictorial scenes the body of the vehicles and the wheels of the vehicle.

FIG. 15 is a front elevation view showing pictorial scene 38, outline 44 of the vehicle body, wheel wells 50 and 52, and wheels 40 and 42. First side 46 of outline 44 has the image of a car disposed thereon, and first side 36 of background element 32 has the images of wheels 40 and 42 disposed thereon. In the shown embodiment the outline 44 and image of a car is used, however outlines and images of other types of vehicles such as trucks or buses are also useful.

Figure 16:
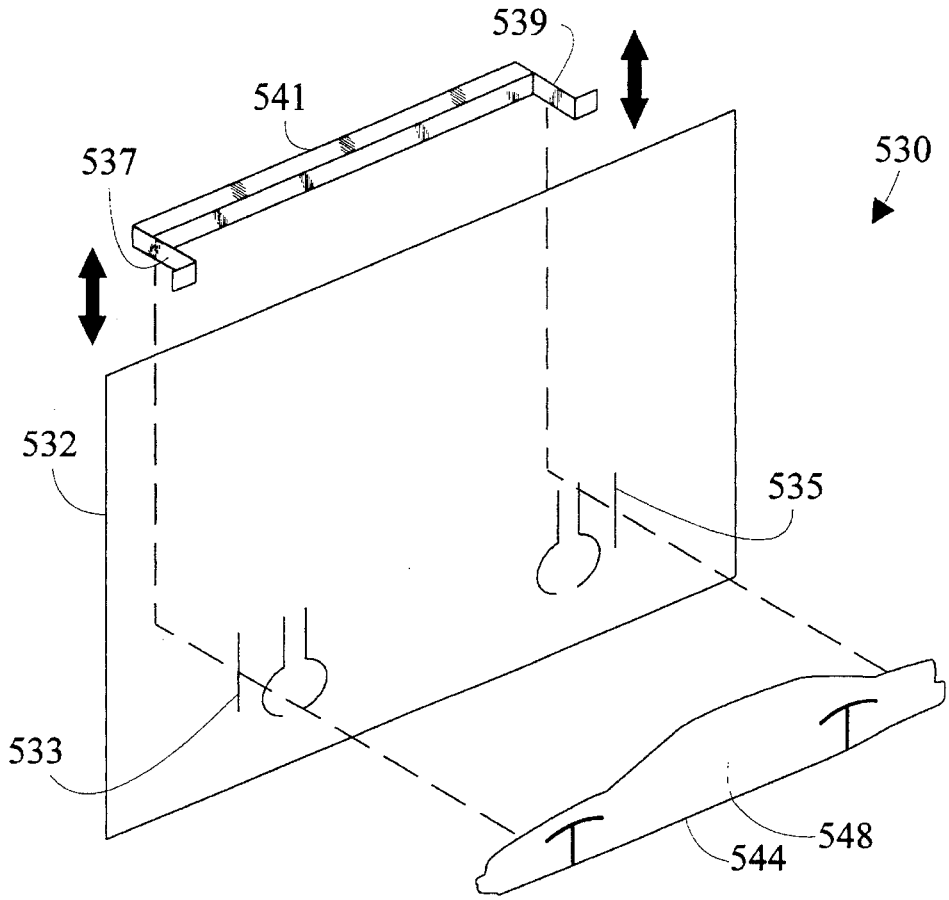
FIG. 16 is a reduced exploded perspective view of a sixth embodiment.

FIG. 16 is a reduced exploded perspective view of a sixth embodiment, generally designated as 530. Background element 532 has two spaced substantially vertical slits 533 and 535. First and second planar members 537 and 539 are connected to longitudinal handle 541, and pass through slits 533 and 535 connect adhesively or otherwise to second side 546 of outline 544 so that outline 544 may be manually moved upwardly or downwardly by handle 541.

Figure 17:
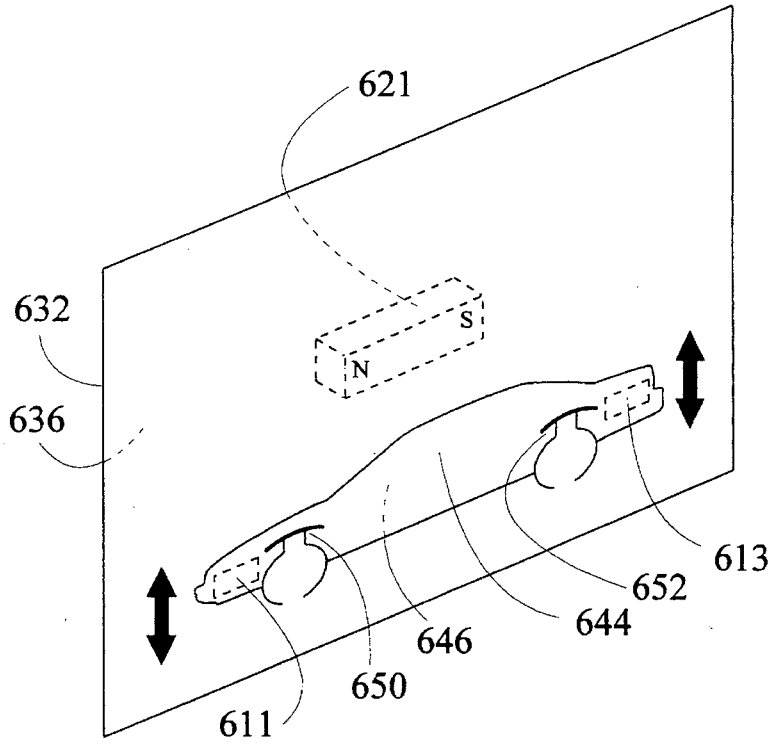
FIG. 17 is a reduced exploded perspective view of a seventh embodiment.

FIG. 17 is a reduced exploded perspective view of a sixth embodiment, generally designated 630. Magnetically responsive material 611 and 613 is disposed on second side 646 of outline 644 opposite wheel wells 650 and 652. Outline 644 may be selectively moved upwardly or downwardly by permanent magnet 621 which is manually manipulated adjacent to second side 636.

Figure 18:
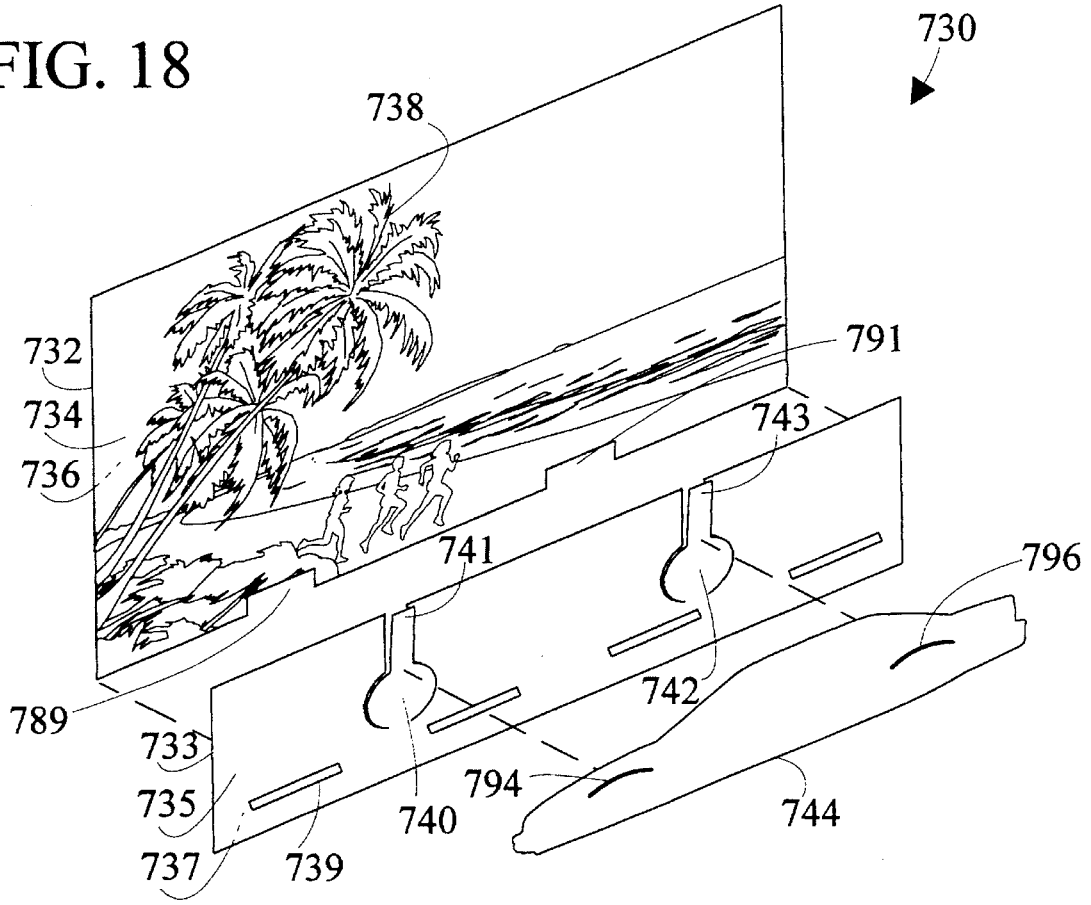
FIG. 18 is a reduced exploded perspective view of an eighth embodiment.

FIG. 18 is a reduced exploded perspective view of an eighth embodiment, generally designated as 730. The background element is partitioned into a background portion 732 having first side 734, second side 736, and background pictorial scene 738, and a foreground portion 733 having first side 735, second side 737, and foreground pictorial scene 739. Background portion 732 has two spaced alcoves 789 and 791. Foreground portion 733 has two spaced wheel tabs 740 and 742 having ends 741 and 743 respectively. Outline 744 of a vehicle has two spaced tab-receiving slots 794 and 796. This embodiment is connected by passing tab ends 741 and 743 through tab-receiving slots 794 and 796 and then passing tab ends 741 and 743 though alcoves 789 and 791 and mechanically connecting them to second side 736 of background portion 732. In the connected configuration second side 736 of background portion 732 slightly overlaps first side 735 of foreground portion 733.

Figure 19:
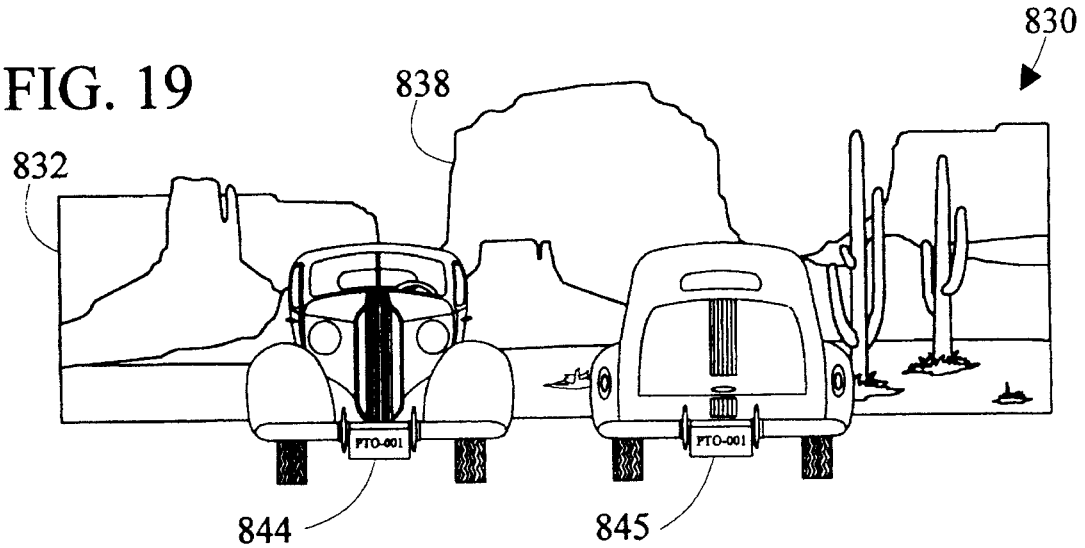
FIG. 19 is a front elevation view of an eighth embodiment.
Figure 20:
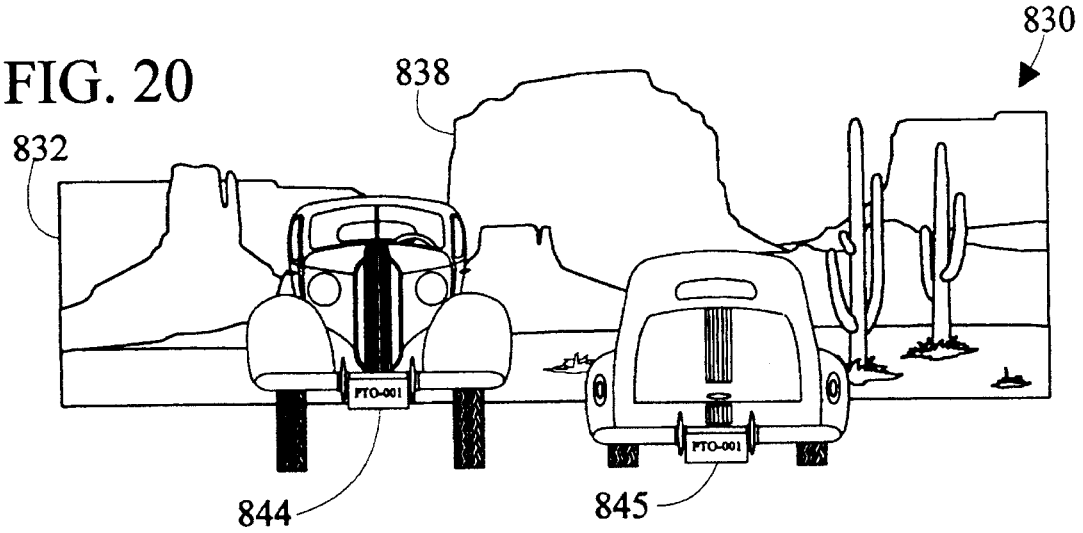
FIG. 20 is a second front elevation view of the eighth embodiment.
Figure 21:
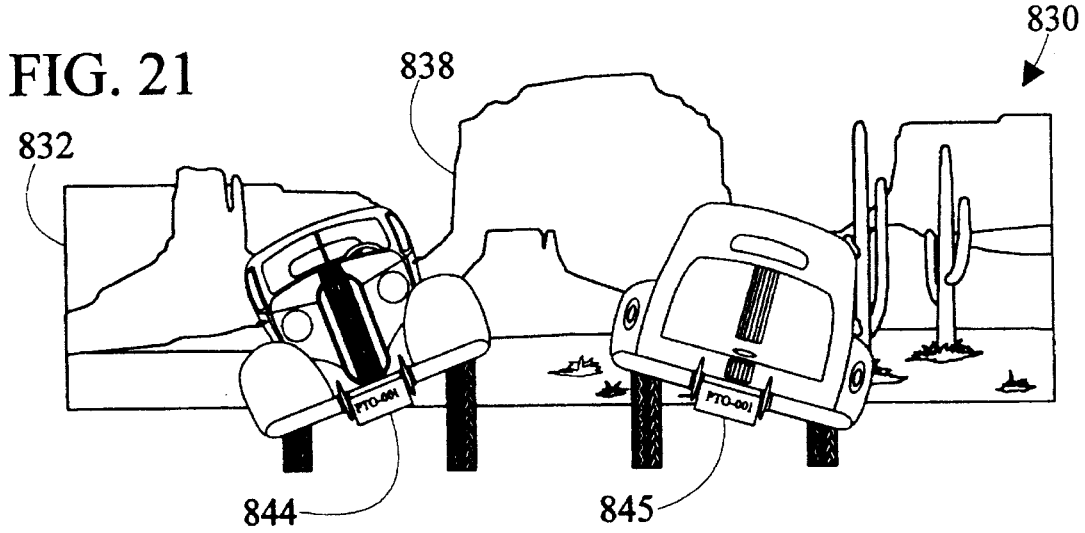
FIG. 21 is a third front elevation view of the eighth embodiment.

FIGS. 19, 20, and 21 are front elevation views of and ninth embodiment, generally designated as 830. In FIG. 19 front facing outline 844 and rear facing outline 845 are shown in their middle position against background element 832 having pictorial scene 838. In FIG. 20 outline 844 has been raised, and outline 845 has been lowered. In FIG. 21 outline 844 and outline 845 have their left sides raised. It is readily appreciated that an infinite number of other combinations are also possible.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An apparatus for displaying a representation of a vehicle in various poses with respect to a pictorial scene, comprising:

a substantially planar background element having a first side and a second side, said pictorial scene disposed on said first side, a first wheel and a second wheel integral with said background element;

a substantially planar outline of a body of said vehicle having a first side and a second side, said outline of said body of said vehicle further having a first wheel well spaced a predetermined distance from a second wheel well;

a first pose-positioning means connected to said background element, said first wheel well slidably engaging said first pose-positioning means, said first pose-positioning means further including a first pair of spaced slits forming a first strap having two ends connected to said planar background element, said first strap having a lower portion having the shape of said first wheel and having a first predetermined diameter, said first wheel well having a T-shaped cut slidably engaging said first strap; and, a second pose-positioning means connected to said background element, said second wheel well slidably engaging said second pose-positioning means, said second pose-positioning means further including a second pair of spaced slits forming a second strap having two ends connected to said planar background element, said second strap having a lower portion having the shape of said second wheel and having a second predetermined diameter, said second wheel well having a T-shaped cut slidably engaging said second strap.

2. An apparatus according to claim 1, wherein said first wheel well and said second wheel well are independently slidable with respect to said pictorial scene.

3. An apparatus according to claim 1, said first and second wheel wells having a substantially vertical direction of slidability with respect to said pictorial scene.

4. An apparatus according to claim 3, said first and second wheel wells further having upward and downward limits of slidability imposed by said first and second pose-positioning means.

5. An apparatus according to claim 1, wherein an image of said vehicle is disposed on said first side of said outline of said body of said vehicle and on said first and second wheels.

6. An apparatus according to claim 1, said outline of said body of said vehicle further including an aperture so that said pictorial scene may be viewed therethrough.

7. An apparatus according to claim 6, said aperture having the shape of a window.

8. An apparatus according to claim 1, wherein said outline of said body of said vehicle is selected from a plurality of possible outlines.

9. An apparatus according to claim 1, each of said T-shaped cuts further having a top slit having a length less than said predetermined diameter of said wheel, so that said top slit cannot pass over said wheel thereby limiting the downward excursion of said wheel well.

10. A method for displaying a representation of a wheeled vehicle in various poses with respect to a pictorial scene, comprising:

providing an apparatus having a background element having a pictorial scene, an outline of a body of said vehicle having two wheel wells, and two straps integral with said background element and two T-shaped cuts in said wheel wells slidably engaging said straps; and, independently sliding said wheel wells along said straps to thereby assume a plurality of poses with respect to said pictorial scene.

* * * * *